US006409979B1

(12) United States Patent
White

(10) Patent No.: US 6,409,979 B1
(45) Date of Patent: Jun. 25, 2002

(54) SELECTIVE PRECIPITATION OF NICKEL AND COBALT

(75) Inventor: David Thomas White, Yangebup (AU)

(73) Assignee: Centaur Nickel Pty Limited, South Melbourne (AU)

( * ) Notice: Subject to any disclaimer, the term of this patent is extended or adjusted under 35 U.S.C. 154(b) by 0 days.

(21) Appl. No.: 09/462,106

(22) PCT Filed: Jul. 23, 1998

(86) PCT No.: PCT/AU98/00583

§ 371 (c)(1),
(2), (4) Date: Apr. 7, 2000

(87) PCT Pub. No.: WO99/06603

PCT Pub. Date: Feb. 11, 1999

(30) Foreign Application Priority Data

Aug. 1, 1997 (AT) ..... P0 8371

(51) Int. Cl.[7] ..... C22B 23/00; C22B 47/00
(52) U.S. Cl. ..... 423/140; 423/147; 423/50
(58) Field of Search ..... 423/138, 140, 423/147, 150.1, 50

(56) References Cited

U.S. PATENT DOCUMENTS

| | | | |
|---|---|---|---|
| 2,899,300 | A | 8/1959 | Bailey |
| 3,466,144 | A | 9/1969 | Kay |
| 3,720,749 | A | 3/1973 | Taylor et al. |
| 3,787,301 | A | 1/1974 | Bozec et al. |
| 4,547,348 | A | 10/1985 | Lussiez et al. |
| 4,548,794 | A | 10/1985 | Lowenhaupt et al. |
| 5,571,308 | A | 11/1996 | Duyvesteyn et al. |

FOREIGN PATENT DOCUMENTS

| | | |
|---|---|---|
| AU | 55397/80 | 8/1980 |
| AU | 22766/92 | 7/1992 |
| DE | 1175440 | 8/1964 |
| DE | 2047371 | 7/1972 |
| DE | 2739872 | 3/1978 |
| FR | 821783 | 12/1937 |
| FR | 2097641 | 3/1972 |
| FR | 2131822 | 11/1972 |
| JP | 4276033 | 10/1992 |
| JP | 05-125464 | 5/1993 |
| JP | 05-279765 | 10/1993 |
| JP | 06-279881 | 10/1994 |

OTHER PUBLICATIONS

J.E. Fittock, Statutory Declaration, Australian Petty Patent No. 701829, Jul. 26, 2000.
M.J. Price, Statutory Declaration (with Exhibits MJP–9 and MJP–10), Australian Petty Patent No. 701829, Jul. 27, 2000.
White, D.T., Statutory Declaration, Australian Petty Patent No. 701829, Mar. 30, 2000.
Probert, James K.S., Statutory Declaration, Australian Petty Patent No. 701829, Apr. 3, 2000.
Price, M.J., Statutory Declaration, Australian Petty Patent No. 701829, Dec. 20, 1999.

*Primary Examiner*—Steven Bos
(74) *Attorney, Agent, or Firm*—Christensen O'Connor Johnson Kindness PLLC

(57) ABSTRACT

A method for precipitating nickel and cobalt from an acid aqueous solution containing at least dissolved nickel, cobalt and manganese, comprising adding solid caustic calcined magnesium oxide or freshly slurried caustic calcined magnesium oxide to the solution in an amount sufficient to precipitate a substantial proportion of the nickel and cobalt in solution and to precipitate a minor proportion of the manganese in solution; maintaining the magnesium oxide in contact with the solution for a period of about 1 hour to about 9 hours to thereby achieve precipitation of a substantial proportion of the nickel and cobalt in solution and precipitation of a minor proportion of the manganese in solution; and separating solids precipitated in the prior step from the aqueous solution.

19 Claims, 2 Drawing Sheets

SELECTIVE PRECIPITATION OF NICKEL AND COBALT

Figure 1:
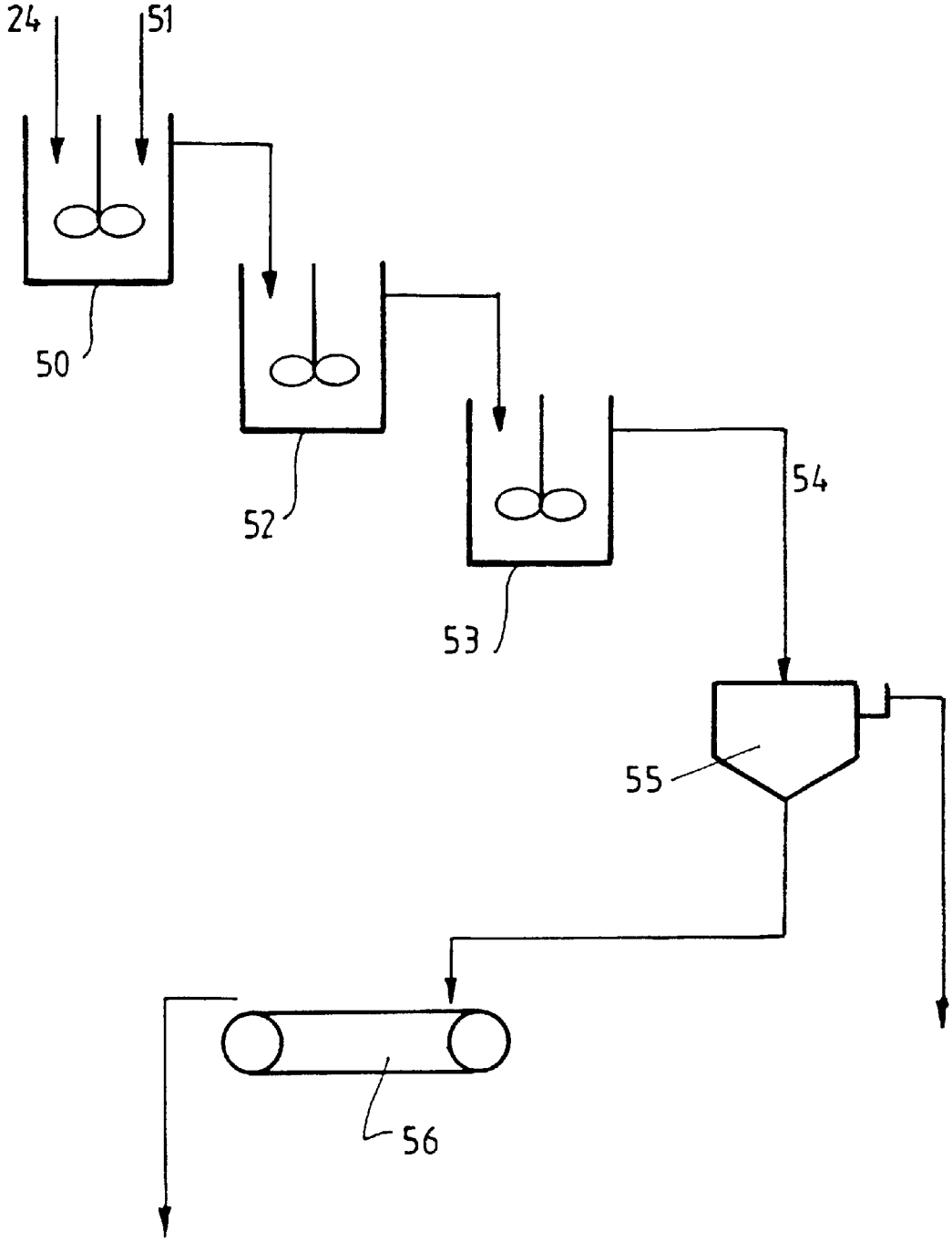

This is a United States national stage application of International application No. PCT/AU98/00583, filed Jul. 23, 1998, the benefit of the filing date of which is hereby claimed under 35 U.S.C. §120, which in turn claims the benefit of Australian application No. PO 8371, filed Aug. 1, 1999, the benefit of the filing date of which is hereby claimed under 35 U.S.C. §119.

The present invention relates to a method for precipitating nickel and cobalt from acidic aqueous solutions. The method is suitable for use in the recovery of nickel and cobalt from ores or concentrates, especially lateritic ores and concentrates obtained from lateritic ores.

Lateritic ores are commonly treated to recover nickel and cobalt therefrom by pressure leaching with an acid. This results in the extraction of nickel and cobalt from the ore into the aqueous phase. The leaching step also results in the extraction of other metals in the ore into the aqueous phase. Typically, manganese, magnesium and iron are also leached from the ore and a mixed solution containing several metal ions is produced.

Typical nickel-ore processing plants treat the leach solution to produce a precipitate containing nickel and cobalt and further treat the precipitate to separately recover nickel and cobalt at a satisfactory purity. The further treatment of the precipitate may involve a further leaching to extract nickel and cobalt, followed by liquid-liquid extraction to separate the nickel and cobalt and recovery stages to separately recover nickel and cobalt.

Operating experience with plants that treat nickel ores has shown that a number of difficulties exist in the treatment of the aqueous phase resulting from the pressure acid leaching of the ore. For example, adding sodium hydroxide or sodium carbonate to the acidic leach solution results in a very fine or slimy precipitate being formed which is difficult to settle and filter. Filter cake washing can also be difficult due to the small particle size of the precipitate. Precipitation with calcium hydroxide results in the formation of an insoluble calcium sulphate precipitate, resulting in contamination of the nickel/cobalt product. Precipitation of nickel and cobalt as a sulphide is selective and gives a precipitate that is readily filterable. However, the equipment required to carry out the precipitation is capital intensive, as is the equipment required to produce the hydrogen sulphide. The resultant nickel cobalt sulphide requires pressure leaching to dissolve, which also requires high cost equipment. The sulphate that results requires eliminating either as ammonium sulphate or sodium sulphate. This requires ammonia or sodium hydroxide to be used as the neutralising agent, both of which are expensive.

Another method of precipitating nickel and cobalt from leach solutions is to add magnesium oxide to the acidic leach solutions. Precipitation with magnesium oxide should result in the dissolution of magnesium to form soluble magnesium sulphate. However, this is frequently an imperfect operation which results in a nickel/cobalt product containing high levels of magnesium.

All of the above techniques apart from sulphide precipitation also lack selectivity with respect to manganese precipitation, resulting in a nickel/cobalt precipitate high in manganese.

An earlier patent recognising some of the above difficulties is Australian Patent No. 655774 (AU-B-22766/92) in the name of Hoefer. This patent discusses the treatment of a liquor from a leaching or beneficiation circuit for oxidised nickel-containing ore by precipitating the valuable species and to pass the liquor through a thickener/filtration circuit to separate the valuable species from the liquor. The patent states that this is not a satisfactory solution for nickel because the nickel precipitates that can form most readily, such as nickel hydroxides and sulphides, are gelatinous and difficult to thicken and filter. In particular, the nickel precipitates tend to blind filters quickly. The patent addresses the problems of thickening and filtering by adding an inert particulate carrier and a flocculant to the liquor to form flocs. However, this process requires the addition of further materials to the liquor and does not address the issue of manganese precipitation.

U.S. Pat. No. 2,899,300 in the name of Bailey (assigned to Quebec Metallurgical Industries Ltd) discloses a process for treating nickel lateritic ores. The process incudes contacting the ore with sulphuric acid in an amount sufficient to saturate the ore. The acid-saturated ore is dried by baking at a temperature between 100–150° C. and subsequently crushed. The crushed ore is then leached with water to obtain a leach solution containing nickel and cobalt values, as well as iron, manganese and chromium. The pH of this leach solution is then adjusted to within the range of 3.5–4.2 to precipitate ferric iron. After removing the iron-containing precipitate, reactive magnesia (either in powder or milk form) is added to the solution to bring its pH up to about 8.2 to thereby precipitate a nickel-containing concentrate. Practically all of the nickel and cobalt is precipitated from solution, along with the remaining iron and about 50% of the manganese. The precipitate is stated to settle rapidly to a dense pulp.

The example included in this patent treats a lateritic ore having a low manganese content of 0.26 wt % Mn. The leach liquor has a ratio of (nickel plus cobalt) to manganese in the leach liquor of 11.2. The same ratio in the final precipitate is 17.9, showing that only a relatively small concentration of nickel and cobalt relative to manganese, is achieved. In other words, the precipitation is not selective to nickel and cobalt precipitation. Accordingly, the process described in U.S. Pat. No. 2,899,300 would be only suitable for treatment of lateritic ores having low manganese contents.

Furthermore, the precipitated product contains significant quantities of iron (6.2 wt %). This can be deleterious because the presence of iron in the precipitate can suppress re-leaching of nickel and cobalt from the precipitate.

U.S. Pat. No. 3,466,144 in the name of Kay (assigned to American Metal Climax, Inc.) describes a hydrometallurgical process for recovering nickel and cobalt from nickeliferous oxidic ores. In the process, the ore is leached with sulphuric acid at elevated temperature and pressure. The loaded solution is separated from the solid residue. The pH of the loaded solution is increased to about 3.4–4.5 by adding lime or magnesia to precipitate iron, aluminium and silicon whilst the nickel, cobalt and manganese remain in solution. The resulting precipitate is separated from the solution.

The loaded solution is then treated by adding magnesia until the pH is at least 8 in order to precipitate the nickel, cobalt and manganese. The thus-formed hydroxides of nickel, cobalt and manganese are then separated from the solution (e.g. by vacuum filtration) and the filter cake is washed with water and sent for further refining.

U.S. Pat. No. 3,466,144 discloses a two-stage precipitation in which iron is first removed from solution, followed by a non-selective precipitation of nickel, cobalt and manganese from solution. This results in a solid precipitate that contains significant quantities of manganese.

U.S. Pat. No. 3,720,749 in the name of Taylor et. al. (also assigned to American Metal Climax, Inc.) discloses a process similar to that described in U.S. Pat. No. 3,466,144 but with the improvement that the first stage precipitation to remove impurities such as dissolved iron, aluminium and silicon from the solution is conducted by adjusting the pH at elevated temperature and pressure. This enables a wider pH range to be used for the first stage precipitation. The second stage precipitation to precipitate nickel, cobalt and manganese from solution may be conducted by adding a neutralising agent to cause precipitation of hydroxides or by adding $H_2S$ to cause precipitation of sulphides. Example 2 shows the stage 2 precipitation being conducted by adding MgO until the pH of the leach solution falls within the range of 5.6 to 8.8. This resulted in precipitation of 88.4% of the nickel, 83.7% of the cobalt, 57.8% of the manganese and 30.6% of the chromium. Clearly, the process does not provide for selective precipitation of nickel and cobalt over manganese.

The present invention provides a method for precipitating nickel and cobalt that overcomes or at least ameliorates one or more of the disadvantages of the prior art.

According to the present invention, a method is provided for precipitating nickel and cobalt from an acid aqueous solution containing at least dissolved nickel, cobalt and manganese, the method including:

a) adding solid caustic calcined magnesium oxide or freshly slurried caustic calcined magnesium oxide to the solution, the magnesium oxide being added in an amount sufficient to precipitate a substantial proportion of the nickel and cobalt in solution and to precipitate a minor proportion of the manganese in solution;

b) maintaining the magnesium oxide in contact with the solution for a period of about 1 hour to about 9 hours to thereby achieve precipitation of a substantial proportion of the nickel and cobalt in solution and precipitation of a minor proportion of the manganese in solution; and c) separating solids precipitated in step (b) above from the aqueous solution. Preferably, the method of the present invention further includes the steps of:

i) determining the amounts of nickel, cobalt and manganese in solution;

ii) determining the amount of magnesium oxide required to effect precipitation of a substantial proportion of the nickel and cobalt in solution and a minor proportion of the manganese in solution; and iii) adding the determined amount of magnesium oxide to the solution.

Step (ii) above most preferably includes the steps of:

iia) determining a theoretical amount of magnesium oxide to be added to the solution to cause the precipitation of a substantial proportion of the nickel and cobalt in solution and a minor proportion of the manganese in solution, said theoretical amount of magnesium oxide being determined by stoichiometric requirements to obtain said precipitation; and iib) adjusting the theoretical amount of magnesium oxide determined in step (iia) above by multiplying or dividing the theoretical amount by an efficiency factor to obtain an addition amount of magnesium oxide, said efficiency factor being determined to account for residence time and reactivity of the magnesium oxide.

The addition amount of magnesium oxide is then added to the aqueous solution. Laboratory and pilot plant testing conducted by the present inventors have found that the "efficiency" of the magnesium oxide is around 70–90%. In other words, about 70–90% of the magnesium oxide added to the aqueous solution effectively participates in the precipitation reaction. Thus, the addition amount of magnesium oxide may typically be calculated by dividing the theoretical amount of magnesium oxide (determined from stoichiometric requirements) by an efficiency factor of 0.7–0.9.

It is preferred that the substantial proportion of nickel and cobalt in solution that is precipitated comprises from about 80% to about 100% of the nickel and cobalt in solution, respectively, most preferably about 90%. It is preferred that the minor proportion of manganese that is precipitated comprises from about 5% to about 15%, most preferably about 8% of the manganese in solution. (All percentages are given on a weight % basis).

It is especially preferred that the solution being treated is substantially free of dissolved iron because dissolved iron may suppress re-leaching of the nickel and cobalt from the precipitate during later processing or refining of the precipitate.

The precipitant or precipitating agent added to the aqueous solution comprises solid caustic calcined magnesium oxide or freshly slurried caustic calcined magnesium oxide. Tests by the present inventors have discovered that slurried magnesium oxide undergoes an "ageing" phenomenon and becomes less effective as the time from slurrying increases. Consequently, the most effective precipitant was solid or freshly slurried caustic calcined magnesium oxide. By "freshly slurried", it is meant that the magnesium oxide had been slurried for not longer than 6 hours prior to mixing with the aqueous solution. For ease of materials handling, it is preferred that the magnesium oxide has been slurried to enable pumping to be used to add the magnesium oxide to the aqueous solution.

If solid caustic calcined magnesium oxide is used, it is preferably in the form of fine particulate matter or a powder.

To allow the reaction to proceed substantially to completion, a reaction time of between one (1) and nine (9) hours is required, preferably from 1 to 6 hours, most preferably from 3 to 5 hours. If the residence time is less than 1 hour, incomplete dissolution of magnesium oxide occurs and the solid precipitate recovered is contaminated with magnesium oxide. If the residence time is greater than about 9 hours, selectivity in precipitation is diminished and the precipitate will contain higher levels of precipitated impurities.

The temperature of the precipitation step is preferably from about 30° C. to about 90° C., with a temperature of about 50° C. being especially suitable.

It is preferred that the pH of the aqueous solution is adjusted to 4.5 to 6.0 prior to adding the magnesium oxide, although this is not critical.

The magnesium oxide added to the aqueous solution must be a caustic calcined magnesium oxide.

Suitable commercial supplies of caustic magnesia that may be used in the present invention include CAUSMAG AL4 and CAUSMAG TGM supplied by Causmag International, P.O. Box 438, Young, New South Wales 2594, Australia, and EMAG 75 and EMAG 45 sold by Queensland Magnesia (Marketing) Pty Ltd, PO Box 445, Toowong, Queensland 4066, Australia. Other caustic calcined magnesia may also be suitable for use in the present invention.

The aqueous solution fed to the precipitation process, in addition to containing nickel, cobalt and manganese ions, may also include any or all of magnesium, sulphate and chloride ions.

The aqueous solution recovered from step (c) of the present invention may contain unprecipitated nickel and cobalt in solution. It is preferred that this solution is treated to precipitate the remaining nickel and cobalt, for example, by a non-selective precipitation using magnesium or lime as a precipitating agent. The thus-precipitated nickel and cobalt may then be returned to the leaching circuit where the mixed precipitate is dissolved. A substantial proportion of the manganese may also report to the mixed precipitate.

The method of the present invention results in the formation of a nickel-cobalt hydroxide precipitate that has the following properties.

1) Low in magnesium;
2) Low in manganese;
3) Settles and filter readily;
4) Is soluble at atmospheric pressure in dilute hydrochloric acid, dilute sulphuric acid, ammonium sulphate solutions, and ammoniacal ammonium carbonate solutions.

The method of the present invention provides for the selective precipitation of nickel and cobalt from acidic leach solutions, especially sulphate, chloride or mixed sulphate-chloride leach solutions, using magnesium oxide to produce a mixed nickel-cobalt precipitate which is low in magnesium and manganese and settles and filters readily. This product in turn is readily releached in hydrochloric acid, sulphuric acid, ammonium sulphate or ammoniacal ammonium carbonate solutions. It has surprisingly been found that the settling and filtration properties of the precipitate are favourable and the precipitate settles readily, and in fact may be self draining. Vacuum filtration properties are extremely favourable with primary filtration rates in excess of 5000 kilograms per square meter per hour being measured. This in turn allows the washing of entrained soluble salts to be straight forward.

The present invention provides a process for the selective precipitation of nickel and cobalt from a leach solution containing at least nickel, cobalt and manganese. The process allows for selective precipitation of nickel and cobalt over manganese to produce a nickel/cobalt containing precipitate having low quantities of manganese therein. Prior art processes have been unable to achieve selective precipitation of nickel and cobalt over manganese, thus rendering treatment of lateritic ores or concentrates having manganese therein difficult or expensive. The precipitate also displays favourable settling and filtration properties.

It is particularly preferred that the ratio, by weight, of (Ni+Co)/Mn in the precipitate is at least five (5) times larger than the ratio, by weight, of (Ni+Co)/Mn in the solution prior to precipitation.

Figure 2:
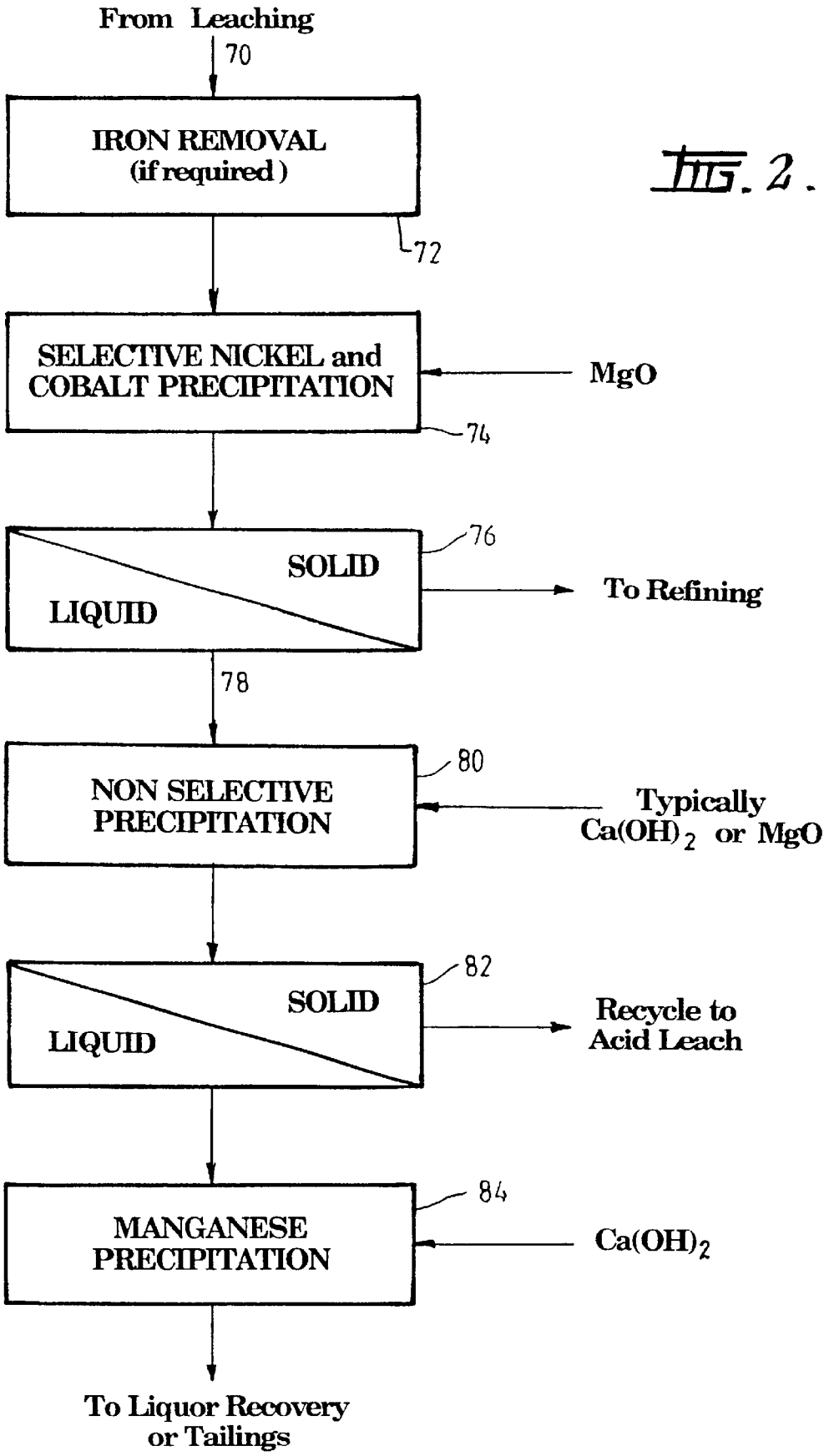

A preferred embodiment of the present invention will now be described with reference to the accompanying Figures in which:

FIG. 1 shows a flowsheet of the precipitation process of the present invention; and FIG. 2 shows part of a larger flowsheet incorporating the precipitation process of FIG. 1.

The flowsheet shown in FIG. 1 may be used in any process where selective precipitation of cobalt and nickel is required, for example, in the recovery of nickel and cobalt from lateritic ores.

Referring now to FIG. 1, the feed solution 24 containing dissolved Ni, Co, Mn and possibly other metals such as Mg and Cu is fed to a first reactor 50. Magnesium oxide 51 is also fed to reactor 50. The resulting mixture of feed solution and magnesium oxide (or magnesium oxide slurry) passes through two further reactors 52, 53 in order to obtain the desired residence time and plant throughput. After leaving reactor 53, the liquor/precipitate mixture 54 is passed to a thickener 55. Underflow from thickener 55 is then passed to a vacuum filter 56 in order to remove further liquid from the precipitate. Overflow from hydroxide thickener 55 is sent to a non-selective precipitation step to recover any remaining nickel and cobalt therefrom.

It will be appreciated that overflow from the hydroxide thickener 55 can be treated by a number of methods to recover the residual nickel and cobalt values and eliminate manganese. For example, a non selective precipitation of nickel and cobalt can be carried out using magnesium oxide or calcium hydroxide as the precipitant, followed by thickening and recycling of the precipitate to an acid leach. The remaining manganese containing solution can be further treated with calcium hydroxide and an oxidant if necessary to precipitate the manganese for disposal. Alternatively, the remaining nickel and cobalt can be precipitated as sulphides and the manganese containing liquor discarded.

In the flowsheet shown in FIG. 2, which is part of a larger flowsheet that incorporates the flowsheet of FIG. 1, a loaded or pregnant leach solution 70 is fed to an iron removal process 72 (if required). The solution obtained from iron removal process 72 is then treated to selectively precipitate nickel and cobalt in accordance with the present invention. This step is denoted by reference numeral 74 in FIG. 2. It will be appreciated that reference numeral 74 in FIG. 2 corresponds to the flowsheet that is upstream of thickener 55 in FIG. 1. Thickener 55 of FIG. 1 corresponds to solid/liquor separation step 76 in FIG. 2. Liquor 78 from solid/liquor separation step 76 (which corresponds to the overflow from thickener 55 in FIG. 1) is subjected to non-selective precipitation 80 by adding magnesia or lime (or any other suitable precipitating agent) to thereby precipitate any remaining nickel and cobalt values in solution. Solid/liquid separation 82 is used to recover the mixed precipitate for recycle to the acid leading circuit, whilst the solution may be optionally further treated with lime at 84 to precipitate further manganese.

The present invention will now be described with reference to the following examples.

EXAMPLE 1

A liquor containing 2.82 g/L nickel, 0.68 g/L cobalt, 2.75 g/L manganese and 6.3 g/L magnesium was contacted in an agitated vessel at 50° C. for 2 hours with a caustic calcined magnesia known as Causmag AL4 at a rate of 3.3 grams of Causmag AL4 per liter of solution.

The final liquor and precipitate assays were:

| | Nickel | Cobalt | Manganese | Magnesium |
|---|---|---|---|---|
| Liquor (g/L) | 0.25 | 0.015 | 2.67 | 7.06 |
| Precipitate (% w/w) | 29.7 | 7.9 | 3.0 | 9.9 |
| % precipitated | 91.4 | 97.9 | 9.0 | |

It can be seen that over 90% of the nickel and cobalt have precipitated, while only 9% of the manganese has precipitated.

Whereas the (nickel plus cobalt) to manganese ratio in the feed liquor is 1.27:1, in the precipitate it is 12.5:1.

Based on the above, the efficiency or reactivity of the Causmag AL4 is 72%.

EXAMPLE 2

A liquor containing 2.69 g/L nickel, 0.66 g/L cobalt, 2.78 g/L manganese, and 6.37 g/L magnesium was contacted with a caustic calcined magnesia known as EMAG 75 in an arrangement as shown in FIG. 1.

The addition rate of EMAG 75 was 3.56 g/L, temperature 50° C. and total residence time in the reactors was 2 hours.

The final liquor and precipitate assays were:

| | Nickel | Cobalt | Manganese | Magnesium |
|---|---|---|---|---|
| Liquor (g/L) | 0.40 | 0.058 | 2.43 | 6.99 |
| Precipitate (% w/w) | 23.9 | 5.65 | 2.87 | 10.2 |
| % precipitated | 85.0 | 91.3 | 12.6 | |

While 85% of the nickel and 91.3% of the cobalt have precipitated, only 12.6% of the manganese has precipitated.

Whereas the (nickel plus cobalt) to manganese ratio in the feed liquor is 1.21:1, in the precipitate it is 10.3:1.

Based on the above, the efficiency or reactivity of the EMAG 75 is 64%

EXAMPLE 3

A liquor containing 4.56 g/L nickel, 1.26 g/L cobalt, 8.76 g/L manganese and 5.79 g/L magnesium was contacted with a caustic calcined magnesia known as EMAG 75 in a continuous pilot plant similar to that shown in FIG. 1.

The addition rate of magnesia was 4.63 g/L, temperature 50° C., and total residence time in the reactors was 3 hours.

The final liquor and precipitate assays were:

| | Nickel | Cobalt | Manganese | Magnesium |
|---|---|---|---|---|
| Liquor (g/L) | 0.636 | 0.16 | 8.12 | 6.55 |
| Precipitate (% w/w) | 25.8 | 7.51 | 4.14 | 2.08 |
| % precipitated | 86.1 | 87.3 | 7.3 | |

While 86% of the nickel and 87% of the cobalt are precipitated, only 7.3% of the manganese have precipitated.

Whereas the (nickel plus cobalt) to manganese ratio in the feed liquor is 0.66:1, in the precipitate it is 8.0:1.

Based on the above, the efficiency or reactivity of the EMAG 75 is 84%. Vacuum filtration tests were carried out on slurries produced in the above manner. Filtration form times of 5 seconds were achieved, with total dewatering times of 35 to 45 seconds.

These correspond to form filtration rates of between 5,000 and 7,500 kg/hr/m$^2$ and total filtration rates of between 700 and 820 kg/hr/m$^2$.

Vacuum was applied between 56 kpa and 63 kpa. Temperature 50° C. Feed slurry 27–31% solids, filter cake 41–44% solids.

EXAMPLE 4

A liquor containing 4.63 g/L nickel, 0.83 g/L cobalt, 5.60 g/L manganese and 6.51 g/L magnesium was contacted with a caustic calcined magnesia known as EMAG 75 in a continuous pilot plant similar to FIG. 1.

The addition rate of magnesia was 4.30 g/L with a total residence time in the reactors of 292 minutes.

The final liquor and precipitate assays were:

| | Nickel | Cobalt | Manganese | Magnesium |
|---|---|---|---|---|
| Liquor (g/L) | 0.50 | 0.064 | 5.07 | 8.44 |
| Precipitate (% w/w) | 34.4 | 5.81 | 5.63 | 1.06 |
| % Precipitated | 88.8 | 91.3 | 11.4 | |

While 88.8% of the nickel and 91.3% of the cobalt were precipitated based on the mass balance, only 11.4% of the manganese was precipitated.

Whereas the (nickel plus cobalt) to manganese ratio in the feed liquor is 0.97:1, in the precipitate it is 7.14:1.

Based on the above, the efficiency or reactivity of the EMAG 75 is 87%.

The above discharge liquor containing 0.50 g/L nickel, 0.064 g/L cobalt, 5.07 g/L manganese and 8.44 magnesium was reacted with calcium hydroxide, added as hydrated lime, at a rate of 11.3 grams of CaO per liter of solution. This step incorporates non-selective precipitation to recover the remaining nickel and cobalt in solution.

The final liquor and precipitate assays were:

| | Nickel | Cobalt | Manganese | Magnesium |
|---|---|---|---|---|
| Liquor (g/L) | 0.002 | 0.003 | 3.77 | 7.99 |
| Precipitate (% w/w) | 7.34 | 1.38 | 17.8 | 1.95 |
| % Precipitated | 99.4 | 95.1 | 16.6 | |

This precipitate was recycled to an acidic leach for recovery of the nickel and cobalt values.

EXAMPLE 5

A liquor containing 3.63 g/L nickel, 1.07 g/L cobalt and 7.31 g/L manganese was contacted with a caustic calcined magnesia known as Emag 75 in a continuous pilot plant similar to FIG. 1.

The addition rate of magnesia was 4.4 g/L with a total residence time in the reactors of 184 minutes.

The final liquor and precipitate assays were:

| | Nickel | Cobalt | Manganese | Magnesium |
|---|---|---|---|---|
| Liquor (g/L) | 0.25 | 0.098 | 7.06 | |
| Precipitate (% w/w) | 24.2 | 7.05 | 3.11 | 2.03 |
| % Precipitated | 93.1 | 90.8 | 3.4 | |

It can be seen that over 90% of the nickel and cobalt have precipitated based on liquor analysis, while only 3.4% of the manganese has precipitated.

Whereas the (nickel plus cobalt) to manganese ratio in the feed liquor is 0.64:1, in the precipitate it is 10.04:1.

Based on the above, the efficiency or reactivity of the EMAG 75 is 72%.

The above discharge liquor containing 0.25 g/L nickel, 0.098 g/L cobalt and 7.06 g/L manganese was reacted with calcium hydroxide, added as hydrated lime, at a rate of 3.74 grams of CaO per liter of solution. This step incorporates non-selective precipitation to recover the remaining nickel and cobalt in solution.

The final liquor and precipitate assays were:

| | Nickel | Cobalt | Manganese | Magnesium |
|---|---|---|---|---|
| Liquor (g/L) | 0.01 | 0.006 | 5.12 | |
| Precipitate (% w/w) | 2.18 | 0.78 | 17.7 | 2.22 |
| % Precipitated | 96.0 | 93.9 | 27.5 | |

This precipitate was recycled to an acidic leach for recovery of the nickel and cobalt values.

EXAMPLE 6

A liquor containing 2.80 g/L nickel, 0.67 g/L cobalt, 2.78 g/L manganese and 6.31 g/L magnesium was contacted with a caustic calcined magnesia known as Emag 75 at a rate of 3.77 grams of Emag 75 per liter of solution, over a period of 2 hours.

The final liquor and precipitate assays were:

| | Nickel | Cobalt | Manganese | Magnesium |
|---|---|---|---|---|
| Liquor (g/L) | 0.29 | 0.024 | 2.52 | 7.11 |
| Precipitate (% w/w) | 26.2 | 6.77 | 2.64 | 11.0 |
| % Precipitated | 89.6 | 96.4 | 9.4 | |

While 89.6% of the nickel and 96.4% of the cobalt were precipitated based on liquor analyses, only 9.4% of the manganese has precipitated.

Whereas the (nickel plus cobalt) to manganese ratio in the feed liquor is 1.24:1, in the precipitate it is 12.48:1.

Based on the above, the efficiency or reactivity of the Emag 75 is 62%.

Comparative Example 1

A liquor containing 3.27 g/L nickel, 0.814 g/L cobalt, 1.33 g/L manganese and 5.54 g/L magnesium was contacted with a slurry of EMAG 75, which had aged for a period in excess of 24 hours.

The addition rate of EMAG 75 was 10.2 g/L, temperature 50° C. and total residue time in the reactors was 5 hours.

The final liquor and precipitate assays were:

| | Nickel | Cobalt | Manganese | Magnesium |
|---|---|---|---|---|
| Liquor (g/L) | 0.008 | 0.004 | 0.633 | 6.46 |
| Precipitate (% w/w) | 12.4 | 3.03 | 4.77 | 19.7 |
| % precipitated | 99.8 | 99.5 | 52.4 | |

The overdosing of magnesium has resulted in significantly less selectivity of nickel and cobalt precipitation over manganese precipitation.

Magnesium contamination is high due to overdosing.

Filtration rates of 400 kg/hr/m$^2$ were obtained from this example, which are significantly less than those of example 3.

In addition, the amount of nickel and cobalt filtered relative to the total solids is considerably less than example 3.

Comparative Example 2

A liquor containing 3.24 g/L nickel, 0.806 g/L cobalt, 2.88 g/L manganese and 5.25 g/L magnesium was contacted with a slurry of EMAG 75 which had aged for a period in excess of 24 hours.

The addition rate of EMAG 75 was 5.6 g/L, temperature 50° C., and total residue time in the reactors was 5 hours.

The final liquor and precipitate assays were:

| | Nickel | Cobalt | Manganese | Magnesium |
|---|---|---|---|---|
| Liquor (g/L) | 0.523 | 0.147 | 1.48 | 7.72 |
| Precipitate (% w/w) | 15.3 | 3.49 | 6.07 | 7.41 |
| % precipitated | 84 | 82 | 49 | |

The selectivity of nickel and cobalt precipitation over manganese is significantly less than that of examples 1 to 5. The (nickel plus cobalt) to manganese ratio in the feed liquor is 1.40:1 increasing to only 3.10:1 in the precipitate.

Comparative Example 3

A liquor containing 2.69 g/L nickel, 0.66 g/L cobalt and 2.80 g/L manganese was contacted with a caustic calcined magnesia known as Causmag AL4 at a rate of 5.3 grams of Causmag AL4 per liter of solution, over a period of 6 hours.

The final liquor and precipitate assays were:

| | Nickel | Cobalt | Manganese | Magnesium |
|---|---|---|---|---|
| Liquor (g/L) | 0.001 | 0.002 | 1.71 | |
| Precipitate (% w/w) | 21.87 | 4.95 | 12.21 | 7.3 |
| % Precipitated | 99.8 | 99.7 | 38.9 | |

Substantially complete nickel and cobalt precipitation has been achieved. However, the selectivity of the nickel and cobalt precipitation over manganese is less than examples 1 to 6. The (nickel plus cobalt) to manganese ratio in the feed liquor is 1.19:1 increasing to only 2.19:1 in the precipitate.

It will be appreciated that the invention described herein is susceptible to variations and modifications other than those specifically described. It is to be understood that the invention encompasses all such variations and modifications that fall within its spirit and scope.

What is claimed is:

1. A method for precipitating nickel and cobalt from an acid aqueous solution containing at least dissolve nickel, cobalt an manganese, the method including the steps of:

(a) determining amounts of nickel, cobalt and manganese in the acid aqueous solution;

(b) determining an amount of magnesium oxide required to effect precipitation of a substantial proportion of the nickel and cobalt in solution and to effect precipitation of a minor proportion of the manganese in solution to form a solid precipitate including nickel, cobalt and manganese such that a weight ratio of (Ni+Co)/ in the solid precipitate is at least five times larger than a weight ratio of (Ni+Co)/Min in the acid aqueous solution;

(c) adding the determined amount of magnesium oxide, in the form of solid caustic calcined magnesium oxide or freshly slurred magnesium oxide, to the aqueous solution;

(d) maintaining the magnesium oxide in contact with the acid aqueous solution for a period of from about 1 hour to about 9 hour to thereby achieve precipitation of the substantial proportion of the nickel and cobalt in solution and the minor proportion of the manganese in solution such that the weight ratio of (Ni+Co)/Mn in the solid precipitate is at least five times larger than the weight ratio of (Ni+Co)/Mn in the acid aqueous solution supplied to step (c); and (e) separating a mixture from step (d) into precipitated solids and a liquor.

2. A method as claimed in claim 1 wherein (b) includes the steps of:

b(i) determining a theoretical amount of magnesium oxide to be added to the solution to cause the precipitation of a substantial proportion of the nickel and cobalt in solution and a minor proportion of the manganese in solution, said theoretical amount of magnesium oxide being determined by stoichiometric requirements to obtain said precipitation; and b(ii) adjusting the theoretical amount of magnesium oxide determined in step (b)(i) above by multiplying or dividing the theoretical amount by an efficiency factor to obtain said amount of magnesium oxide, said efficiency factor being determined to account for residence time and reactivity of the magnesium oxide.

3. A method as claimed in claim 2 wherein the efficiency factor is from 70% to 90% and step (b)(ii) comprises the step of determining the addition amount by dividing the theoretical amount by 0.7 to 0.9.

4. A method as claimed in any one of claim 1, 2, or 3 wherein from about 80% to 100% of the nickel in solution is precipitated.

5. A method as claimed in claim 4 wherein about 90% of the nickel in solution is precipitated.

6. A method as claimed in claim 1 or 2 wherein from about 80% to 100% of the cobalt in solution is precipitated.

7. A method as claimed in claim 6 wherein about 90% of the cobalt in solution is precipitated.

8. A method as claimed in claim 1 or 2 wherein from about 5% to about 15% of the manganese in solution is precipitated.

9. A method as claimed in claim 8 wherein about 8% of the manganese in solution is precipitated.

10. A method as claimed in claim 1 wherein the acid aqueous solution supplied to step (c) is subjected to an iron removal step to remove dissolved iron prior to being supplied to step (c).

11. A method as claimed in claim 1 wherein the solid magnesium oxide added to the acid aqueous solution is in the form of fine particulate matter or a powder.

12. A method as claimed in claim 1 wherein a slurry of magnesium oxide is added to the acid aqueous solution wherein, the magnesium oxide has been slurried for not longer than 6 hours prior to mixing with the solution.

13. A method as claimed in claim 1 wherein the period in step (d) is from about 1 hour to about 6 hours.

14. A method as claimed in claim 13 wherein the period in step (d) is from about 3 bows to about 5 hours.

15. A method as claimed in claim 1 wherein the temperature in step (d) is from about 30° C. to about 90° C.

16. A method as claimed in claim 1 wherein the temperature in step (d) is about 50° C.

17. A method as claimed in claim 1 wherein the pH of the acid aqueous solution is adjusted to 4.5 to 6.0 prior to adding the magnesium oxide.

18. A method as claimed in claim 1 wherein the liquor recovered from step (d) is further treated to precipitate any remaining nickel and cobalt in solution.

19. A method as claimed in claim 18 wherein the further treatment of the liquor recovered from step (d) comprises a non-selective precipitation.

* * * * *

UNITED STATES PATENT AND TRADEMARK OFFICE

CERTIFICATE OF CORRECTION

PATENT NO. : 6,409,979 B1
DATED : June 25, 2002
INVENTOR(S) : D.T. White

It is certified that error appears in the above-identified patent and that said Letters Patent is hereby corrected as shown below:

Title page,
Item [*] Notice, insert the following:
-- This patent issued on a continued prosecution application filed under 37 CFR 1.53(d), and is subject to the twenty year patent term provisions of 35 U.S.C. 154(a)(2). --
Item [30], Foreign Application Priority Data, "(AT)" should read -- (AU) --

Column 10,
Line 45, "at least dissolve" should read -- at least dissolved --
Line 46, "cobalt an manganese," should read -- cobalt and manganese, --
Line 54, "(Ni+Co)/" should read -- (Ni+Co)/Mn --
Line 54, "(Ni+Co)/Min" should read -- (Ni+Co)/Mn --
Line 61, "to the aqueous" should read -- to the acid aqueous --
Line 65, "9 hour" should read -- 9 hours --

Column 12,
Line 14, "aqueous solution" should read -- aqueous solution, --
Line 15, "wherein," should read -- wherein --
Line 20, "bows" should read -- hours --
Line 22, "30º C." should read -- 30º C --

Signed and Sealed this

Twenty-sixth Day of August, 2003

JAMES E. ROGAN
*Director of the United States Patent and Trademark Office*